United States Patent [19]

Blake

[11] 3,967,009

[45] June 29, 1976

[54] METHOD FOR APPLYING LIQUID TO A SUBSTRATE

[75] Inventor: Charles William Blake, Basingstoke, England

[73] Assignee: McCorquodale Colour Display Limited, Basingstoke, England

[22] Filed: Sept. 13, 1974

[21] Appl. No.: 505,927

[30] Foreign Application Priority Data

Sept. 13, 1973 United Kingdom ..... 43119/73

[52] U.S. Cl. ..... 427/256; 427/282; 427/288; 427/429

[51] Int. Cl.[2] ..... B41M 5/00

[58] Field of Search ..... 117/37 R, 38, 98, 99, 117/111 D; 401/196, 198, 199; 427/256, 282, 288, 428, 429

[56] References Cited

UNITED STATES PATENTS

| | | | |
|---|---|---|---|
| 2,620,499 | 12/1952 | Dressel | 401/198 |
| 3,377,124 | 4/1968 | Matsumoto | 401/198 |
| 3,464,352 | 9/1969 | Schilling | 401/198 |

FOREIGN PATENTS OR APPLICATIONS

| | | | |
|---|---|---|---|
| 1,053,663 | 1/1967 | United Kingdom | 117/37 R |
| 1,322,183 | 7/1973 | United Kingdom | 117/37 R |
| 1,183,604 | 3/1970 | United Kingdom | 117/37 R |

*Primary Examiner*—Thomas J. Herbert, Jr.
*Assistant Examiner*—Bruce H. Hess
*Attorney, Agent, or Firm*—Stewart and Kolasch, Ltd.

[57] ABSTRACT

This invention provides a method and apparatus for applying liquid to accurately defined areas of solid substrates such as paper, plastics materials and textiles. The method essentially involves the application of the substrate with appreciable pressure to a foraminous outlet disposed at the upper face of a liquid container and the subsequent removal of the substrate therefrom. Care is taken to ensure that the liquid in the container is in wetting contact with the outlet but that there is no development of an external meniscus above the outlet upper surface. In certain preferred embodiments of the invention several liquid containers are provided so that several liquids may be applied at once. The invention finds particular utility in the preparation of "color cards" such as are used for color selection of paints or cosmetics.

16 Claims, 7 Drawing Figures

METHOD FOR APPLYING LIQUID TO A SUBSTRATE

The present invention relates to a method of applying liquid to accurately defined areas of the surface of a solid substrate, the invention being of particular utility for applying liquid colors to sheets of paper.

As will be described in detail below, certain embodiments of the apparatus according to the invention find particular use as a replacement for conventional silk screen apparatus and can thus be used for the application of defined areas of liquid, especially of viscous liquid compositions, to solid substrates such as paper, plastics materials and textiles.

Other embodiments of the apparatus according to the invention can be used in the production of colour cards, that is to say sheets of cards and commonly pre-printed cards, bearing a number of accurately dimensioned patches, or "chips" as they are known in the art, of various colors in predetermined accurately spaced relationship to one another and to such pre-inscribed matter as may be present on the cards. Such cards are used as guides for color selection in, for example, paint and cosmetic applications.

It is envisaged that the invention will find yet further applications; as for example the preparation of medical test strips comprising predetermined quantities of drugs deposited in required areas on a carrier, or high quality multi-color printing by a repeat process in which non-contiguous areas of colors are deposited in a first printing and the remaining colors are then deposited in a second printing, or the printing of advertising material on regularly shaped bottles.

The specification of our earlier U.S. Pat. No. 1,053,663 describes and claims a method of applying a patch of liquid of accurately defined area to the surface of paper, sheet, card or like smoothsurfaced material, said method consisting in charging the liquid into a container having an outlet or outlets shaped to correspond with the required patch or patches, the outlet or outlets being covered by a mesh screen of mesh capable of retarding flow of the liquid from the container by gravity whilst permitting the formation of menisci of the liquid at the face of the mesh screen and applying the paper, sheet, card or the like with breaking contact with the menisci to effect transfer of liquid to the paper, sheet, card or the like without or substantially without pressure between the paper, sheet, card or the like and the mesh screen. It also describes and claims apparatus for carrying out such a method.

Operation of machines embodying this earlier invention has not been without its attendant difficulties as mentioned in our previous Specifications Nos. 1,183,860 and 1,322,183. The present invention is founded on the observation that some of the difficulties can be circumvented using a liquid container having a porous or foraminous outlet at its upper face, provided that the liquid in the container is maintained in wetting contact with the outlet but without the development of an external meniscus above the outlet upper surface, and provided the substrate is applied with appreciable pressure to the outlet.

Specification No. 1,053,663 mentioned the possibility of performing the earlier invention with the container in an inverted position with the outlet uppermost, but still required the formation of menisci and their breaking by contact with the substrate, and the absence of pressure between substrate and screen. The retention of these features does not enable the advantages of the present invention to be obtained.

The method according to the invention for applying liquid to an accurately defined area of a substrate comprises charging the liquid into a container having a porous or foraminous horizontal outlet at its upper face shaped to correspond with the defined area, the liquid being in wetting contact with the outlet and being at a level no higher than the exterior surface of the outlet; applying the substrate with pressure to the outlet such that the defined area on the substrate is impressed onto the outlet of the container; and removing the substrate from the outlet.

During the impression of the substrate to the outlet there should be no relative motion therebetween in the plane of the outlet.

Preferably a substantial region of the substrate is impressed onto the outlet at any one time during the impression. This contrasts with the arrangements described in our earlier Specifications, when contact between substrate and menisci takes place only along a line of contact that advances progressively across a screen.

The invention also provides apparatus for applying liquid to similar accurately defined areas of successive substrates, the apparatus comprising a container for the liquid having a porous or foraminous horizontal outlet at its upper surface shaped to correspond with the defined area; means for maintaining the liquid in wetting contact with the outlet at a level no higher than the exterior surface of the outlet; means for applying successive substrates with pressure to the outlet such that the defined area or the substrate is impressed onto the outlet of the container and for successively removing each substrate after such impression.

Preferably the outlet comprises a foraminous screen covering the upper face of the container. The screen may then be similar to mesh screens used in conventional silk screen printing processes and can, for example, be made of Terylene. It is preferred that the screen is held under high tension over the outlet of the container since this can lessen the tendency for the screen to depress when the substrate is applied with pressure thereto. It is also preferred for like reasons to provide a perforated or porous support beneath the screen.

Where it is desired to apply the same liquid to a plurality of defined areas of the same face of the substrate a plurality of outlets shaped and spaced to correspond with the defined areas is provided. The plurality of outlets may be constituted by covering the container with a single foraminous screen which has been rendered impervious where there are to be no such outlets. It has been found that superior results can be obtained with screens similar to those used in conventional silk screen printing when the impervious coating which is normally adhered to the upper face of the mesh screen is instead adhered to the lower face of an inverted screen.

Where it is desired to apply different liquids to different areas of the same face of the substrate a matrix of wells or individual containers for the respective liquids is provided, each well or container having a corresponding outlet or outlets. Where such a matrix employs a single foraminous screen, measures must be taken to ensure that the liquids cannot intermingle by creep beneath the screen. Such measures preferably involve adhering the impervious parts of the screen to adjacent parts of the container or containers.

The means for applying successive substrates with pressure to the outlet typically includes a roller with a resilient rubber layer around the impressing part of its circumference and grippers on the roller adapted for uptake of the substrate, for holding the substrate during impression and for releasing the substrate after the impression. In this instance the apparatus is preferably double acting, that is successive substrates are fed alternatively from opposite sides of the container or container matrix and are removed after the impression. Where a roller is used the motion of the roller may be imparted by a motor from which operation for substrate feed, grippers and similar repetitive movements can be taken. Either roller or platen action can be used.

Typically the level of the liquid is maintained manometrically, using a reservoir of liquid feeding the container through a U-shaped tube. The level of liquid in the reservoir is then kept substantially level with the porous outlet, due allowance being made where necessary for capillary action in the outlet, as for example when a fine mesh screen is used. Where a reservoir is employed with a fine mesh screen it is usually found that the screen acts to some extent so as to retain the liquid and so as to dampen any momentary differences in the levels of the liquid in the reservoir and the container.

One particularly preferred means for maintaining the liquid in wetting contact with the outlet at a level no higher than the exterior surface of the outlet is a recirculating weir device. Such a device is described in detail below with reference to the drawings and comprises an upper and a lower vessel in communication with one another so that liquid may flow from the upper to the lower vessel under the action of gravity, an outlet in the lower vessel, and means for returning liquid from the lower vessel to the upper one at a rate at least as fast as liquid can flow from the upper to the lower vessel under the action of gravity, said means having an inlet from the lower vessel disposed superior to the outlet of the device. The outlet of the device can then be connected by tubing to the container.

When the substrate is impressed against the outlet the liquid wetting the outlet contacts the substrate and wets it. When the substrate is removed from the outlet a portion of the liquid is pulled through the outlet in a quantity depending on factors such as outlet structure, viscosity, surface tension and speed of separation. The upper portion of the liquid adheres as a film to the substrate and the lower portion falls back into the outlet.

One example of a typical double acting press according to the invention will now be described with reference to the drawings. Such a machine may be used for a variety of purposes depending on, among other things, the sort of container used. In the two particular applications to be described the machine is used for screen printing of paper and for preparing color cards.

Figure 1:
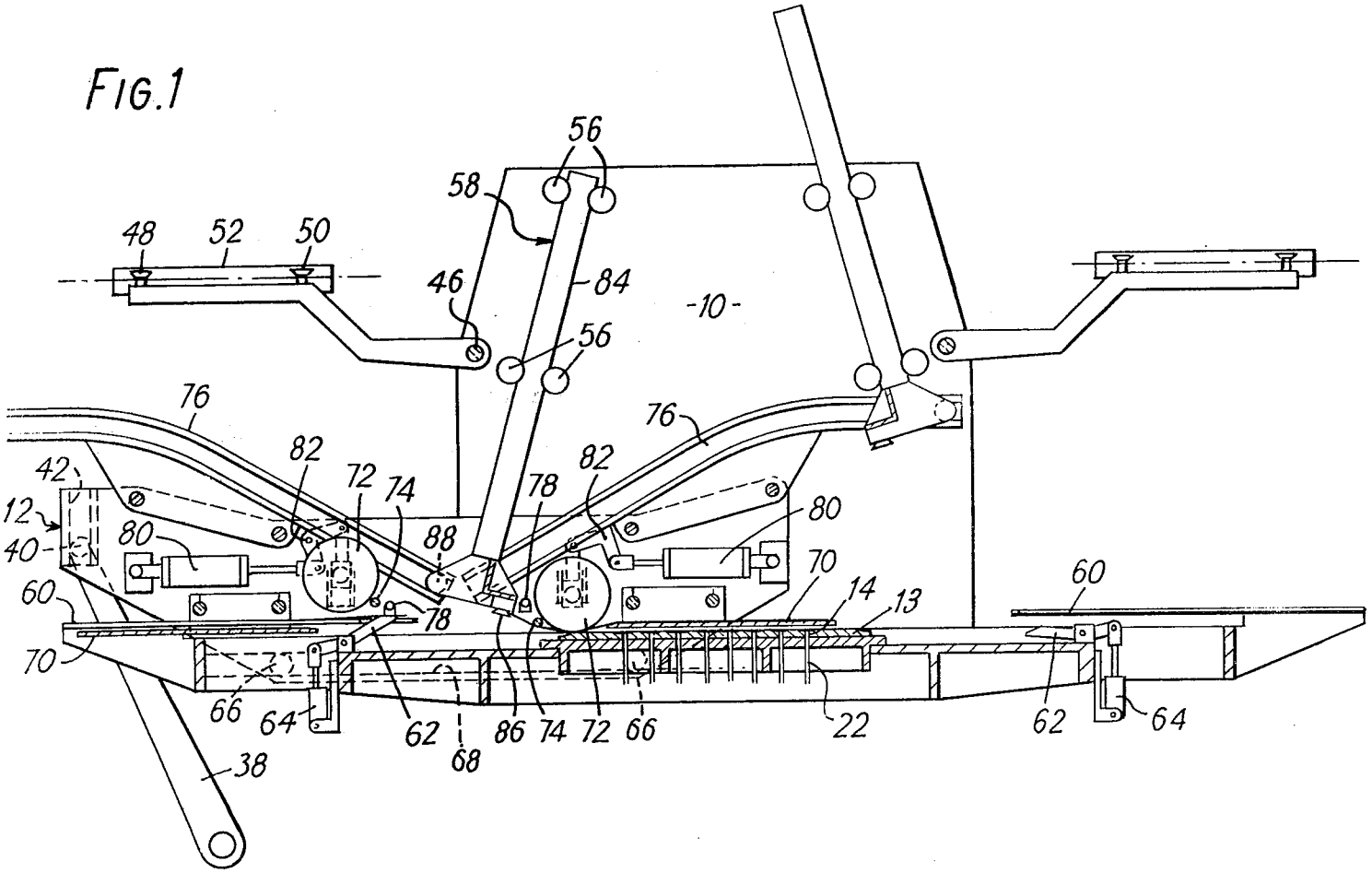
FIG. 1 is a side elevation of a machine for applying different liquids simultaneously to flexible sheet substrates as used for example in the preparation of color cards at the commencement of a print stroke.
Figure 2:
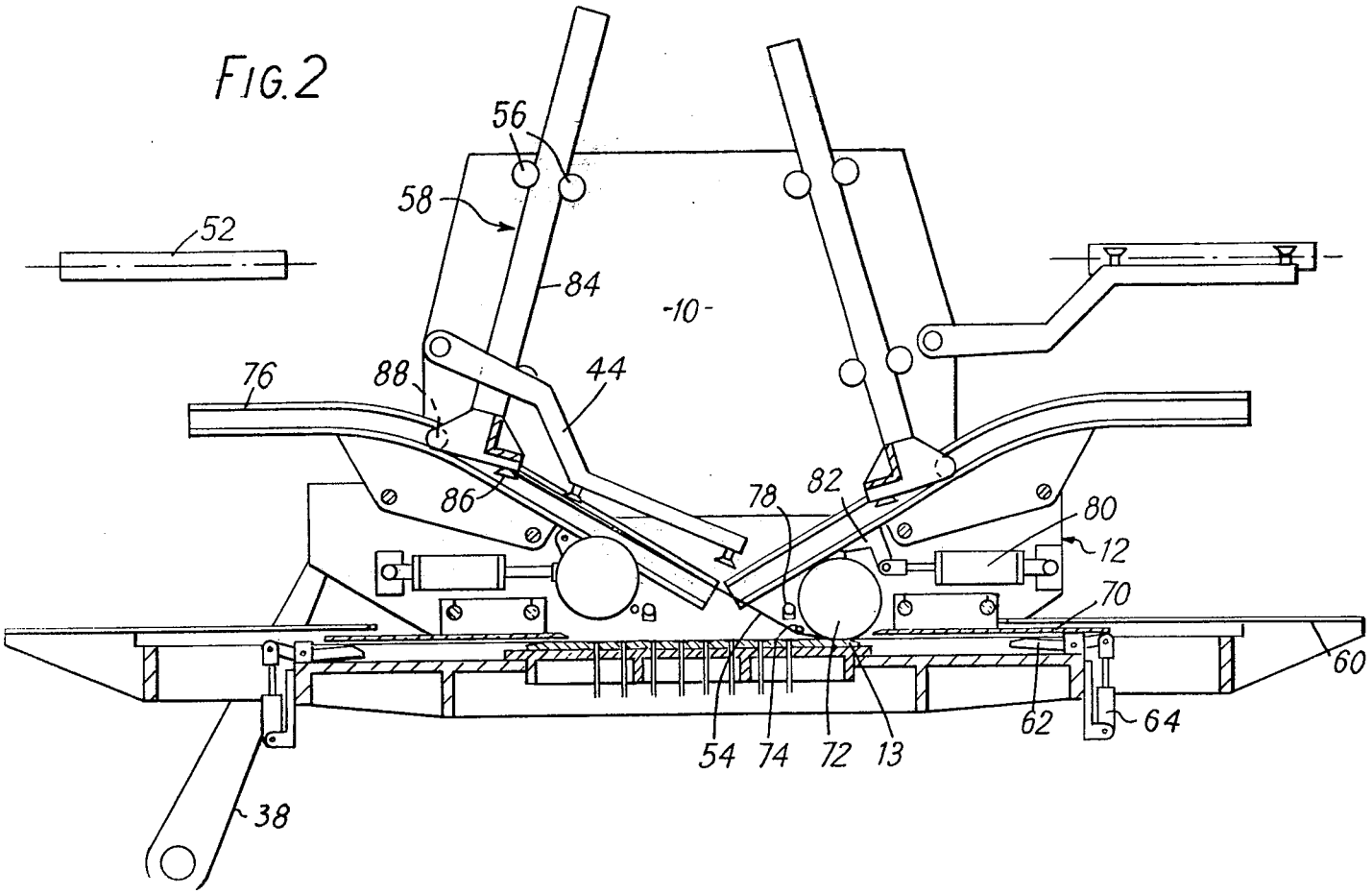
FIG. 2 is a side elevation of the machine of FIG. 1 at the end of a print stroke.
Figure 3:
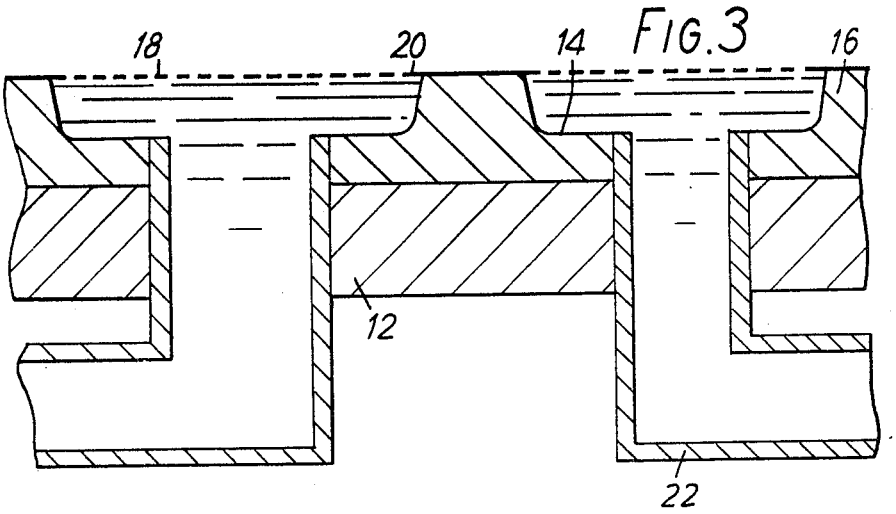
FIG. 3 is an enlargement of part of FIG. 1.
Figure 4:
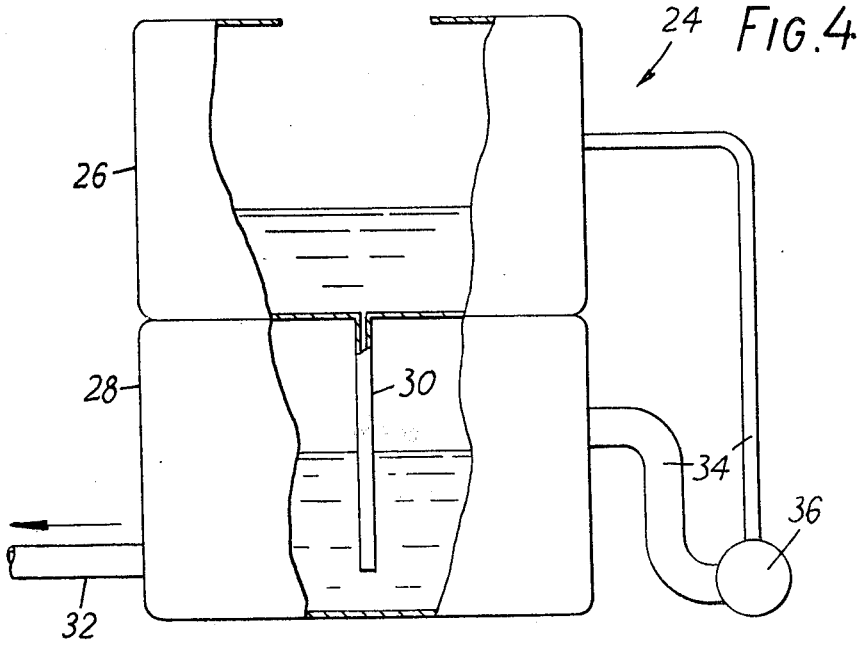
FIG. 4 is a side elevation of recirculating weir device for use with the apparatus of FIG. 1.

As shown in FIG. 1 and FIG. 2, the apparatus comprises a stationary frame 10 and a travelling carriage 12. The frame 10 bears a bed 13 on which a plurality of containers 14 for the liquids to be deposited are mounted. As more clearly shown in FIG. 3, the containers 14 are etched from a zinc plate 16 which is then covered by a tensioned open Terylene screen 18 and stencil 20. Feed tubes 22 lead from the containers 14 to respective recirculating weir devices 24 (FIG. 4) which feed the colors to the containers and maintain the levels thereof. Each weir device 24 comprises an upper vessel 26, a lower vessel 28, a tube 30 leading from the upper vessel to the lower vessel, an outlet 32 in the lower vessel connected to the feed tube 22, and a return pipe 34 with associated pump 36, the pump being disposed below the level of the point of attachment of the pipe 34 to the lower vessel 28. The outlet 32 is disposed below the level of the point of attachment of the pipe 34 to the lower vessel 28.

The frame 10 bears an arm 38 which bears a wheel 40 at one end which rides in a slot 42 on the travelling carriage 12. The other end of the arm is attached to a cam system (not shown). As will be described below the arm 38 moves the travelling carriage 12 in a horizontal direction.

Two take-off arms 44 are attached at one end to axles 46 borne on the frame 10. A pair of suckers 48, 50 are disposed towards the other end. The suckers 48, 50 are provided with conventional vacuum systems (not shown) for picking up a sheet of paper. Each take-off arm 44 is pivotable from a position shown in FIG. 1 where the suckers 48, 50 are in alignment with a take-off roller 52 to a position where the suckers 48, 50 are in contact with a printed sheet of paper 54 (see FIG. 2).

Attached to the frame 10 are pairs of guide rollers 56 which act as guides for gripping arms 58. The frame 10 also bears two feed tables 60, and two feeder levels 62 with associated hydraulic systems 64.

The travelling carriage 12 has rollers 66 and can run along a track bed 68 provided on the frame 10. The carriage 12 has two sheet transfer plates 70, two print rollers 72, two peel-angle rollers 74, two gripping arm trackways 76, and two suckers 78. Associated with each print roller 72 is a hydraulic mechanism 80 and leverage 82 whereby the print roller may be raised and lowered. Each gripping arm 58 has a cylindrical shaft 84, a gripper 86 and a wheel 88. The wheel 88 is held in the associated trackway 76, while the cylindrical shaft 84 is located within the pairs of guide rollers 56.

The operation of the machine will be described with reference to one of the print actions, namely the right hand one of FIGS 1 and 2. It is to be understood that the machine is essentially double acting and that there are in fact two overlapping print actions which are half a cycle out of phase.

A single sheet of paper is delivered by feed means (not shown) to a feed table 60 while the carriage 12 is at the far extreme of its travel, that is to the right hand table 60 for the situation shown in FIG. 1.

The traveller carriage 12 then returns along the track bed 68 on its rollers 66 to the other (right hand) extreme of its travel on actuation of the arm 38 by a cam system (not shown). In so returning a previously fed sheet of paper is printed, but the actual printing stroke will be described later in terms of the single sheet of paper currently located on the right hand feed table 60. When the carriage 12 has reached the right hand extreme of its travel the hydraulic system 64 will actuate the lever 62 and press an exposed strip of the sheet of paper against the sucker 78. Such a situation is shown for the left hand print action in FIG. 1.

The sucker 78 then acts to hold the strip of the sheet of paper and the carriage is then moved to the left. In so moving the sheet of paper is drawn off the right hand feed table 60 and onto the right hand sheet transfer plate 70 of the carriage 12. While the carriage moves to the left, the right hand of the two print rollers 72 shown in the Figures is in the raised position.

When the carriage 12 arrives at its left hand extreme of travel the right hand hydraulic mechanism 80 actuates the leverage 82 and the print roller 72 descends to the position shown in FIG. 1. The left hand of the two gripping arms 58 shown in the Figures forms part of the right hand print action. With the left hand arm 58 in the position shown in FIG. 1 the gripper 86 grips the edge of the sheet of paper offered by the sucker 78 and the sucker then releases the paper. The machine is then as shown in FIG. 1 ready for the right hand printing stroke.

The carriage 12 once again travels along the track bed 68 on actuation of the arm 38. As the carriage travels, the left hand gripping arm trackway 76 likewise travels to the right and accordingly since the wheel 88 of the left hand gripping arm 58 is held therein, the left hand cylindrical shaft 84 gradually rises through the pairs of guide rollers 76 on the stationary frame 10. In so doing a constant peel angle of the paper from the screen 18 and stencil 20 is obtained. The peel angle can in fact be adjusted slightly by altering the position of the peel-angle roller 74 relative to the print roller 72.

When the travelling carriage reaches the position shown in FIG. 2 the actual printing stroke has finished and the left hand take-off arm 44 pivots to the position shown and the printed sheet of paper 54 is transferred to the left hand take-off roller 52. At the same time the print roller 72 is lifted and the feeder lever 62 is lowered. The carriage then continues its travel to the extreme right position where it picks up the next sheet of paper for printing.

Figure 5:
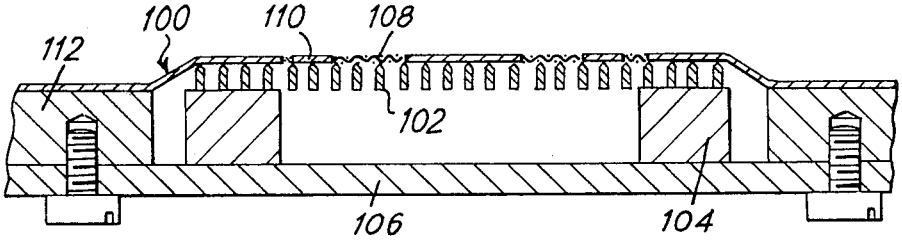
FIG. 5 is a side elevation of a modified container assembly for use with the machine shown in the previous figures when applying a single liquid to a substrate.

FIG. 5 depicts a modified container assembly for use with the above machine when applying a single liquid to a substrate in a manner related to conventional silk screen printing.

The modified container 100 has a perforate etched zinc support 102 which rests on spacers 104 which in turn rest on a backing plate 106. An open screen 108 and stencil 110 is tightly stretched over the support 102 and secured to a frame 112. The screen and stencil are in fact constituted by a Terylene mesh to which a coating conventional in the silk screen printing art has been applied to the underside. Liquid is fed to the container from the side.

Figure 6:
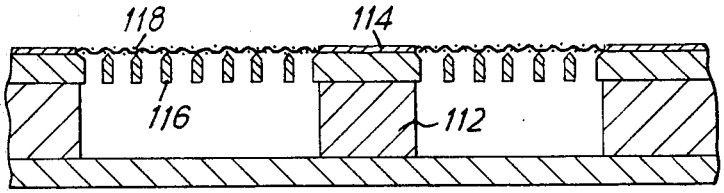
FIG. 6 is a side elevation of an improved container assembly similar to that shown in FIG. 5.

FIG. 6 depicts an improved version of the container assembly shown in FIG. 5. Here extra support 112 is given beneath the stencil 114, and the zinc support 116 is perforated only below the open screen 118.

Figure 7:
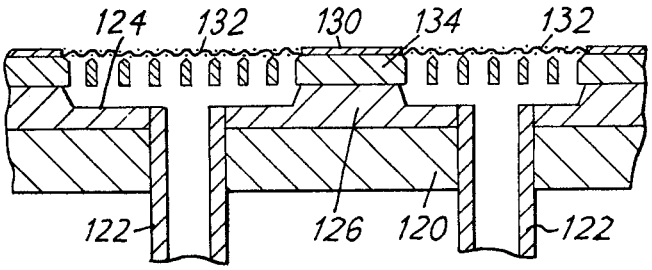
FIG. 7 is a side elevation of a modified container assembly similar to that shown in FIG. 6 for use in multiple liquid application.

The container assembly shown in FIG. 6 may be adapted for the application of several different liquids, as shown in FIG. 7. such an adaptation has a backing plate 120 through which feed tubes 122 lead to containers 124 etched in a zinc plate 126. A second zinc plate 128 is interposed between the plate 126 and the stencil 130 and open screen 132. The second zinc plate 128 is perforated below the open screen 132. The stencil 130 is secured by adhesive to the extra support portions 134 of the second zinc plate 128.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A method for applying liquid to a plurality of accurately defined spaced areas on each of a succession of like substrates, said method comprising the steps of:

providing a rigid bed having a horizontal upper surface formed with a plurality of spaced outlets, said outlets being shaped and spaced to correspond with said defined areas and containing porous or foraminous material having an upper surface substantially coplanar with said horizontal upper surface;

supplying liquid to said rigid bed such that liquid is in wetting contact with said material at each of said plurality of outlets and stands at a level no higher than said upper surface of said material;

successively applying said plurality of substrates with the application of pressure to said rigid bed such that said plurality of areas on each of said substrates is impressed onto said plurality of outlets; and removing in turn each of said substrates from said rigid bed after application of said liquid.

2. The method of claim 1, wherein said horizontal upper surface of said bed is provided by an impervious integral element formed with and surrounding said plurality of spaced outlets.

3. The method of claim 2, wherein a single screen constitutes said integral element formed with and surrounding said outlets and also constitutes said porous or foraminous material occupying said outlets, said single screen being a foraminous screen which has been rendered impervious in that part which constitutes said element.

4. The method of claim 3, wherein said single screen has been rendered impervious by application of a coating to its lower face.

5. The method of claim 3, wherein said screen is under high tension.

6. The method of claim 1, wherein perforate material supports said porous or foraminous material occupying said outlets.

7. The method of claim 1, wherein the same liquid is supplied to two or more of said outlets.

8. The method of claim 1, wherein a different liquid is supplied to each of said outlets.

9. A continuous method for applying liquid to a plurality of accurately defined spaced areas on each of a succession of like substrates, said method comprising the steps of:

providing a rigid bed having a horizontal upper surface formed with a plurality of spaced outlets, said outlets being shaped and spaced to correspond with said defined areas and containing porous or foraminous material having an upper surface substantially coplanar with said horizontal upper surface;

supplying liquid to said rigid bed such that liquid is in wetting contact with said material at each of said plurality of outlets and stands at a level no higher than said upper surface of said material;

successively impressing said plurality of substrates with pressure to said rigid bed such that said plurality of areas on each of said substrates is impressed onto said plurality of outlets and such that a substantial region of the substrate is impressed onto the outlet at any one time during impression; and removing in turn each of said substrates from said rigid bed after application of said liquid.

10. The method of claim 9, in which a screen provides said horizontal upper surface of said rigid bed and also constitutes said porous or foraminous material occupying said outlets, said screen being foraminous in those areas which constitute said material and being impervious in those areas which provide said horizontal upper surface.

11. The method of claim 9, wherein the same liquid is supplied to two or more of said outlets.

12. The method of claim 9, wherein a different liquid is supplied to each of said outlets.

13. The method of claim 1, wherein the substrate is paper.

14. The method of claim 9, wherein the substrate is paper.

15. The method of claim 3, wherein said liquid is maintained within the interstices of the screen and after each pressure contact of the substrate with the screen causing the liquid contained within the screen to be withdrawn, the liquid is quickly replenished and rapidly reaches a state of equilibrium.

16. The method of claim 1, wherein said liquid is supplied to said rigid bed without the formation of a miniscus on the surface of said bed.

* * * * *